US009816672B1

(12) United States Patent
Broughton

(10) Patent No.: US 9,816,672 B1
(45) Date of Patent: Nov. 14, 2017

(54) CONFIGURABLE LIGHT SOURCE

(71) Applicant: Kevin Charles Broughton, Sharpsburg, GA (US)

(72) Inventor: Kevin Charles Broughton, Sharpsburg, GA (US)

(73) Assignee: Cooper Technologies Company, Houston, TX (US)

( * ) Notice: Subject to any disclaimer, the term of this patent is extended or adjusted under 35 U.S.C. 154(b) by 240 days.

(21) Appl. No.: 14/546,052

(22) Filed: Nov. 18, 2014

Related U.S. Application Data

(60) Provisional application No. 61/905,715, filed on Nov. 18, 2013.

(51) Int. Cl.

| | |
|---|---|
| ***F21V 1/00*** | (2006.01) |
| ***F21V 11/00*** | (2015.01) |
| ***F21K 99/00*** | (2016.01) |
| ***F21V 7/00*** | (2006.01) |
| ***F21V 17/02*** | (2006.01) |
| ***F21S 8/00*** | (2006.01) |
| *F21Y 101/02* | (2006.01) |

(52) U.S. Cl.
CPC ..... *F21K 9/1355* (2013.01); *F21K 9/50* (2013.01); *F21S 8/032* (2013.01); *F21V 7/0066* (2013.01); *F21V 17/02* (2013.01); *F21Y 2101/02* (2013.01)

(58) Field of Classification Search
CPC ..... F21K 9/1355; F21K 9/50; F21S 8/032; F21V 7/0066; F21V 17/02; F21Y 2101/02
USPC ..... 362/235, 238, 239, 249.02, 249.03, 277
See application file for complete search history.

(56) References Cited

U.S. PATENT DOCUMENTS

2007/0064415 A1* 3/2007 Wood ..... F21L 4/00 362/205
2010/0033948 A1* 2/2010 Harbers ..... F21V 9/16 362/84
2010/0165643 A1* 7/2010 Russo ..... F21V 21/04 362/365
2010/0264821 A1* 10/2010 Lutz ..... F21V 14/02 315/32
2011/0304269 A1* 12/2011 Wang ..... F21K 9/00 315/113

(Continued)

OTHER PUBLICATIONS

"Cooper Lighting Introduces the Next Generation LED LightBAR System". Cooper Lighting. Oct. 11, 2011. pp. 1-4. http://www.prnewswire.com/news-releases/cooper-lighting-introduces-next-generation-led-lightbar-system-131516713.html.

(Continued)

*Primary Examiner* — Elmito Breval
*Assistant Examiner* — Glenn Zimmerman
(74) *Attorney, Agent, or Firm* — King & Spalding LLP

(57) ABSTRACT

A light source can comprise an optical element, one or more light emitting diodes, and an adjustment. The light emitting diode or diodes can emit light. The optical element can process the emitted light to produce an illumination pattern. The adjustment can change the relative positions of the optical element and the light emitting diodes or diodes, for example by moving some aspect of the optical element or some aspect of the light emitting diode or diodes. The positional change can change the illumination pattern. The adjustment can comprise settings so that the light source can be readily configured to meet predefined application parameters, for example according to IESNA roadway classifications.

20 Claims, 3 Drawing Sheets

(56) References Cited

U.S. PATENT DOCUMENTS

2012/0120664 A1* 5/2012 Farmer ..... F21V 31/005
362/294
2012/0224370 A1* 9/2012 Holder ..... F21V 13/04
362/235

OTHER PUBLICATIONS

"LED Outdoor Lighting: SustainabLEDesign". Cooper Lighting. Oct. 11, 2011. pp. 1-10. Brochure.

* cited by examiner

CONFIGURABLE LIGHT SOURCE

CROSS REFERENCE TO RELATED APPLICATIONS

This application claims priority to U.S. Provisional Patent Application No. 61/905,715 filed Nov. 18, 2013 in the name of Kevin Charles Broughton and entitled "Configurable Light Source," the entire contents of which are hereby incorporated herein by reference.

FIELD OF THE TECHNOLOGY

The present technology relates to light sources for illumination, and more particularly to a light source comprising a light emitting diode (LED) and an optic whose relative positions can be adjusted to produce different illumination patterns.

BACKGROUND

Interest in adoption of light sources based on light emitting diode technology is escalating, as light emitting diodes offer advantages over incandescent lighting and other approaches to converting electrical energy into luminous energy. Such advantages can include longevity and efficiency. Light emitting diodes often come in packages that are very different from conventional incandescent light bulbs or fluorescent bulbs. Additionally, light emitting diodes emit light in a very different geometry than most other conventional illumination sources.

Light sources based on light emitting diodes often have a light-emitting element and a refractive optical element mounted adjacent to one another in fixed positions, resulting in a fixed illumination pattern. Meanwhile, a manufacturer may support a range of products and applications that utilize different illumination patterns that are poorly served by the inflexibility of conventional illumination patterns. In order to achieve the different illumination patterns, manufacturers often resort to making and maintaining a range of unique optics and incurring tooling expenditures and increased production costs.

Improved light source technologies are needed. For example, new technology is needed to support flexible illumination patterns. A capability addressing one or more such needs, or some other related deficiency in the art, would support improved illumination systems, better economics, and/or wider use of light emitting diodes.

SUMMARY

A light source can comprise at least one light emitting diode and an associated optic. The optic can process light produced by the light emitting diode to create an illumination pattern. The illumination pattern can be flexible or configurable.

The light source can comprise an adjustment for positioning the optic and the light emitting diode relative to one another. By varying the relative positions of the optic and the light emitting diode, the adjustment can manipulate the illumination pattern in a controlled manner.

In some examples, the adjustment moves the light emitting diode while the optic remains stationary. In some examples, the adjustment moves the optic while the light emitting diode remains stationary. In some examples, the adjustment moves a portion of the optic while another portion of the optic and the light emitting diode remain stationary. The moved portion of the optic can comprise a mirror that moves within a cavity of a refractive element, for example.

The foregoing discussion of light sources is for illustrative purposes only. Various aspects of the present technology may be more clearly understood and appreciated from a review of the following text and by reference to the associated drawings and the claims that follow. Other aspects, systems, methods, features, advantages, and objects of the present technology will become apparent to one with skill in the art upon examination of the following drawings and text. It is intended that all such aspects, systems, methods, features, advantages, and objects are to be included within this description and covered by this application and by the appended claims of the application.

Figure 1:
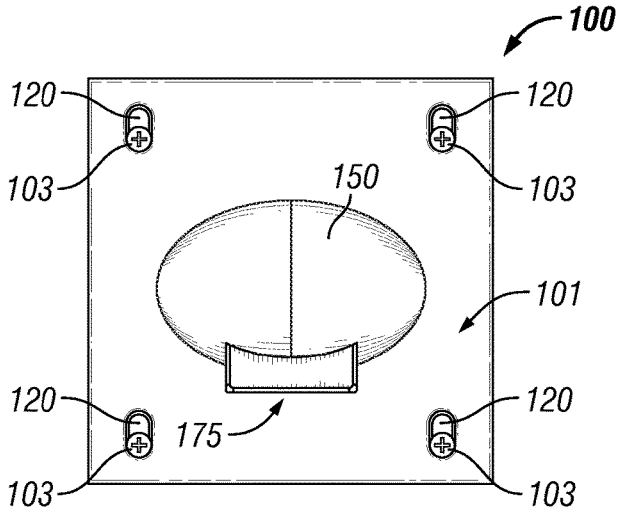
FIG. 1 illustrates an optic, wherein the illustration shades the optic opaque to promote reader perception of surface features, according to some example embodiments of the present technology.

Many aspects of the technology can be better understood with reference to the above drawings. The elements and features shown in the drawings are not necessarily to scale, emphasis being placed upon clearly illustrating the principles of exemplary embodiments of the present technology. Moreover, certain dimensions may be exaggerated to help visually convey such principles.

DESCRIPTION OF EXAMPLE EMBODIMENTS

A light source can comprise an optical element and at least one light emitting diode. An adjustment can change the relative positions of the optical element and the light emitting diode in order to achieve a desired illumination pattern. The adjustment can comprise settings so that the light source can be readily configured to meet predefined application parameters, for example according to roadway classifications of the Illumination Engineering Society of North America (IESNA) or some other appropriate industry organization or governing body.

As discussed in further detail below, the present disclosure supports an optical design in which the position of a light emitter relative to an optical element is adjustable, to achieve multiple illumination patterns with a single lighting system. The resulting configurability can reduce the number of unique optics utilized across a line of products and applications and can improve production and tooling economics and SKU management. Additionally, the adjustability provides an option for factory and/or field configuration, so that a desired illumination pattern can be implemented or fine-tuned at the factory, in the field during installation, or after installation.

Figure 6:
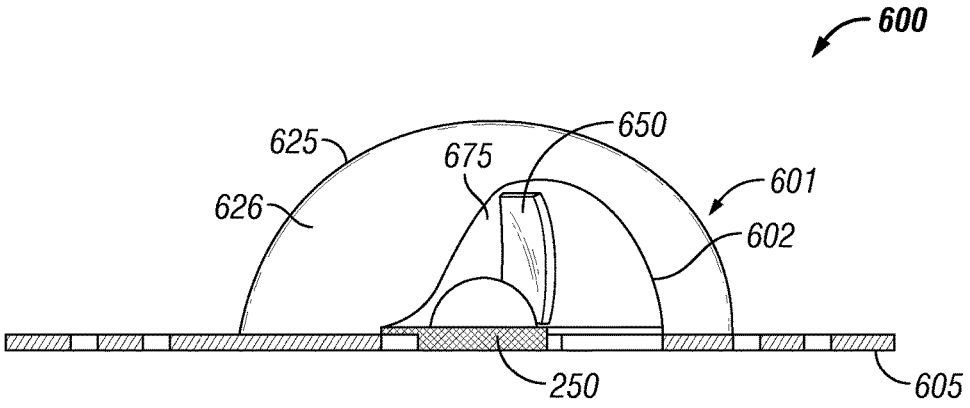
FIG. 6 illustrates a light source comprising an optic with a light emitting diode and a reflector arranged in a first configuration within a cavity of the optic, according to some example embodiments of the present technology.
Figure 7:
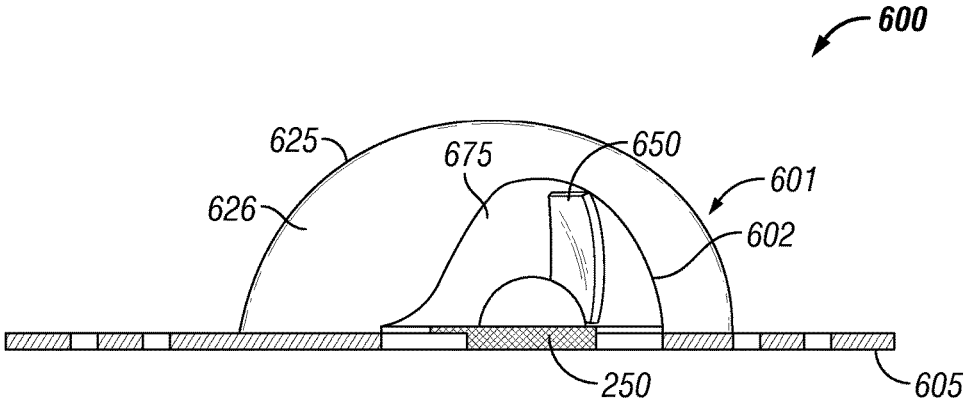
FIG. 7 illustrates the light source of FIG. 6 wherein the light emitting diode and the reflector are arranged in a second configuration within the cavity of the optic, according to some example embodiments of the present technology.
Figure 8:
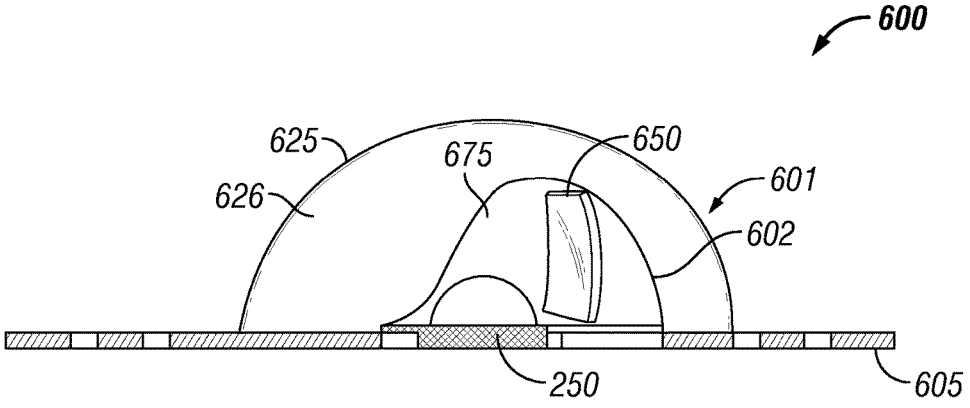
FIG. 8 illustrates the light source of FIG. 6 wherein the light emitting diode and the reflector are arranged in a third configuration within the cavity of the optic, according to some example embodiments of the present technology.

Some representative embodiments will be described more fully hereinafter with example reference to the accompanying drawings. FIGS. 1, 2, 3, 4, and 5 illustrate a first example embodiment, while FIGS. 6, 7, and 8 illustrate a second example embodiment, which are discussed below in turn.

The technology may, however, be embodied in many different forms and should not be construed as limited to the embodiments set forth herein; rather, these embodiments are provided so that this disclosure will be thorough and complete, and will fully convey the scope of the technology to those appropriately skilled in the art.

Figure 2:
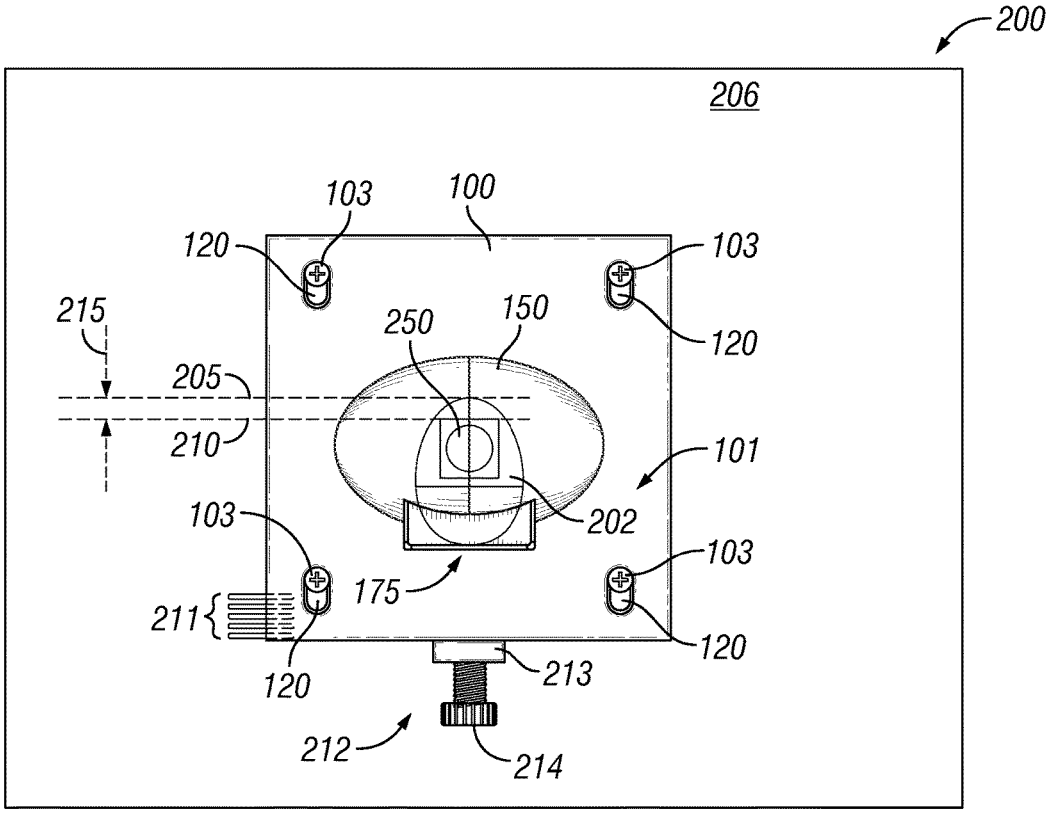
FIG. 2 illustrates the optic and an associated light emitting diode in a first configuration, wherein the optic is shaded partially opaque to promote reader perception of surface features but is illustrated largely transparent to facilitate visibility of the underlying light emitting diode, according to some example embodiments of the present technology.
Figure 3:
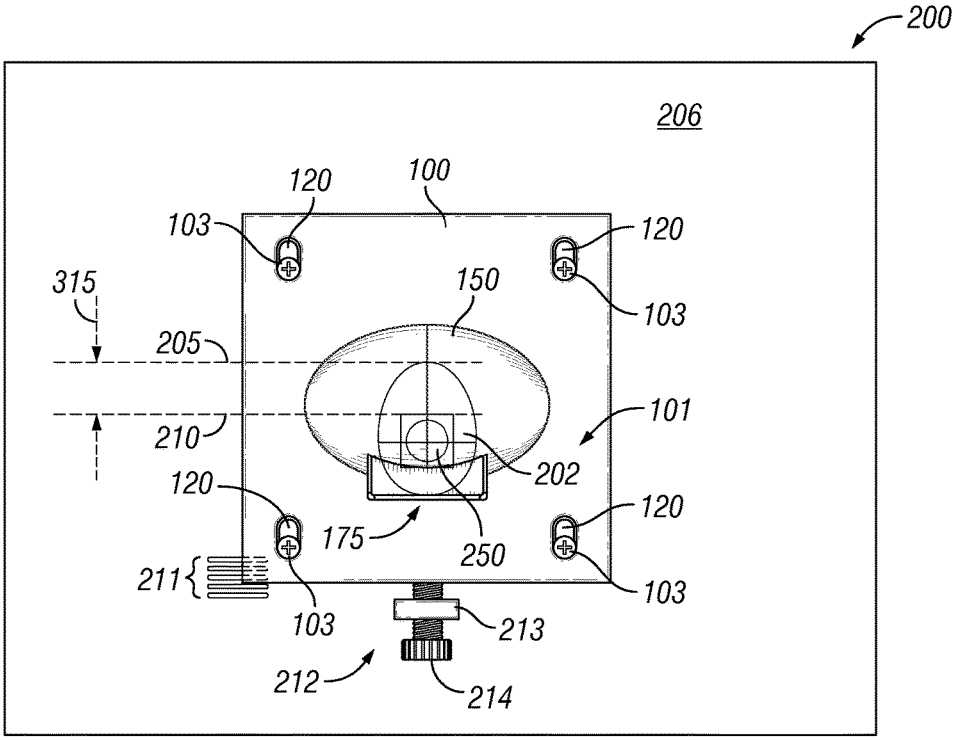
FIG. 3 illustrates the optic and the associated light emitting diode in a second configuration, wherein the optic is shaded partially opaque to promote reader perception of surface features but is illustrated largely transparent to facilitate visibility of the underlying light emitting diode, according to some example embodiments of the present technology.

Turning now to FIGS. 1, 2, and 3, these figures describe an example light source 200 that comprises an example optic 100 and an example light emitting diode 250 in accordance with some embodiments of the technology. FIG. 1 illustrates the optic 100 shaded opaque to promote reader perception of example surface features.

FIG. 2 illustrates the optic 100 and the associated light emitting diode 250 in a first configuration, while FIG. 3 illustrates the optic 100 and the associated light emitting diode 250 in a second configuration. As illustrated in FIGS. 2 and 3, the optic 100 is shaded partially opaque to promote reader perception of example surface features but is depicted largely transparent to facilitate visibility of the underlying light emitting diode 250.

The optic 100 comprises refractive features that may be made from optically clear or slightly opaque material installed over a hemispherically emitting light source, such as the light emitting diode 250. The light emitting diode 250 can be mounted on a substrate 206 that may comprise a heat sink or circuit board. The optic 100 comprises an optically active area that performs the majority of the light control and a flange 101. The flange 101 extends around the perimeter of a refractive dome 150. The flange 101 provides mechanical structure to couple the optic 100 to the substrate 206. In an example embodiment, the underside of the flange 101 rests against and can slide along the upper side of the substrate 206. Accordingly, the optic 100 can move along a horizontal plane. In some embodiments, the optic 100 moves along a vertical plane so that the adjustment moves the light emitting diode 250 further into or out of an internal cavity 202 of the optic 100.

The inner optical cavity 202 provides mechanical clearance around the light emitting diode 250 and is sufficiently large so that the optic 100 can be shifted in lateral directions, transverse directions, and/or vertical directions without unwanted physical interference.

In an example embodiment, the optic 100 can be formed from a single piece of optical material. Thus in some embodiments, the optic 100 can be made as a unitary element or may be seamless. Alternatively, the optic 100 can comprise an assembly of parts.

Slotted holes 120 in the flange 101 accept fasteners 103 (for example screws, pins, rivets, or other appropriate devices) for holding the optic 100 to the substrate 206. The holes 120 can be large enough so that the optic 100 can move laterally and/or transversally with respect to the light emitting diode 250 before being fixed in place. Depending on where the optic 100 is fixed in place, the illumination pattern produced by the light source 200 can significantly vary.

For example, related to outdoor roadway illumination, different illumination patterns falling under different IESNA roadway classifications (such as Type I, II, III, IV, V) can be achieved from a single optical element via moving the optic 100 with respect to the light emitting diode 250. In certain embodiments, the relative positions to produce these light distributions are indicated via graduations, marks, mechanical stops, or other features that may be visible or otherwise readily discernible.

In the illustrated embodiment of FIGS. 2 and 3, an array of features 211 denotes adjustment positions that correspond to the roadway classifications. In an example embodiment, each feature 211 comprises a graduation and a mechanical stop. The mechanical stop may comprise an indentation or protrusion on the surface of the substrate 206, for example.

As illustrated in FIGS. 2 and 3, a lead screw system 212, that provides an example embodiment of a mechanism, moves the optic 100 relative to the substrate 206 and the light emitting diode 250. As illustrated, a female threaded block 213 is fixed to the substrate 206. A threaded screw 214 mates with the threaded block 213 and attaches to the optic 100. Turning the threaded screw 214 moves the optic 100 along the surface of the substrate 206. A person installing a lighting fixture that incorporates the light source 200 can tune the illumination pattern according to application needs by turning the lead screw system 212 to move the optic 100 linearly, for example.

As discussed above, FIG. 1 illustrates a top view of an example embodiment of the optic 100. In the illustrated embodiment, the optic 100 comprises an interior surface that is hidden and that defines a cavity 202 in which the light emitting diode 250 is disposed as shown in FIGS. 2 and 3. The optic 100 comprises an exterior surface that is visible and that includes a protruding totally internally reflective surface 175 for directing light across the optic 100. The flange 101 surrounds the optically active area of the optic 100 and comprises a square perimeter containing slotted holes 120 through the flange 101. The optic 100 can slide linearly between the two extremes of the extents of the slotted holes 120.

FIG. 2 illustrates the optic 100 and the underlying light emitting diode 250 in a configuration in which the light emitting diode 250 is disposed forward within the cavity 202 of the optic 100. This position can correspond to a slot end, so that the slot 120 provides a mechanical stop. As further discussed below, in the illustrated configuration, the resulting light distribution can classify as an IESNA roadway Type II distribution.

FIG. 3 illustrates the optic 100 and the associated light emitting diode 250 in a configuration in which the light emitting diode 250 is disposed towards the rear of the cavity 202 of the optic 100. This position can correspond to the opposing slot end, so that the slot 120 provides two mechanical stops. As further discussed below, in the illustrated configuration of FIG. 3, the resulting light distribution classifies as an IESNA roadway Type III distribution.

FIGS. 2 and 3 illustrate example reference lines 205, 210 that have been overlaid on the drawings to illustrate representative travel distances 215, 315 associated with moving the optic 100 between different IESNA roadway distribution types. In comparison with the configuration of FIG. 2, in FIG. 3, the optic 100 is moved relative to the light source. Accordingly, the slotted holes readily facilitate reconfiguration between Type II and Type III distribution.

In an example embodiment, the light source 200 may be utilized or deployed via a method or process. An example embodiment of such a method or process can comprise providing the light source 200. The light source 200 can comprise one or more light emitting diodes 250, one or more optics 100, and one or more adjustments. In an example embodiment, an adjustment can be connected to a light emitting diode 250 and an optic 100. The adjustment can comprise a first setting and a second setting. A person can make a selection to deploy the light source 200 to meet a first luminous intensity distribution or a second luminous intensity distribution. If the selection is to deploy the light source 200 to meet the first luminous intensity distribution, the person can set the adjustment to the first setting. If the selection is to deploy the light source 200 to meet the second luminous intensity distribution, the person can set the adjustment to the second setting. The settings can be discrete or continuous in various embodiments. In various embodiments, the adjustment can comprise a machine, mechanism, moveable part, system of movable elements, one or more threaded elements, one or more slidable/sliding surfaces, one or more stops, one or more slots, or other appropriate features, for example.

Figure 4:
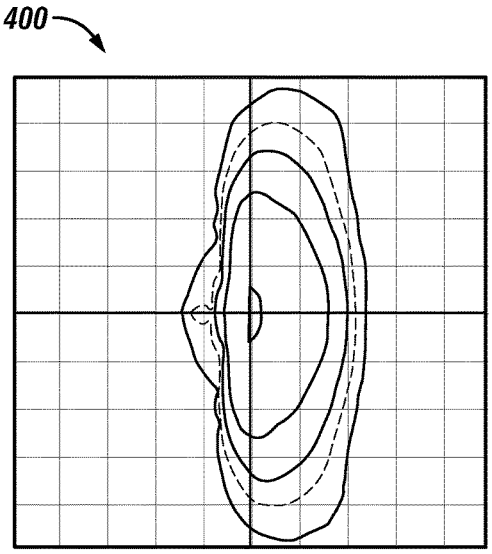
FIG. 4 illustrates a representative light distribution for the optic and the associated light emitting diode in the first configuration that FIG. 2 illustrates, according to some example embodiments of the present technology.
Figure 5:
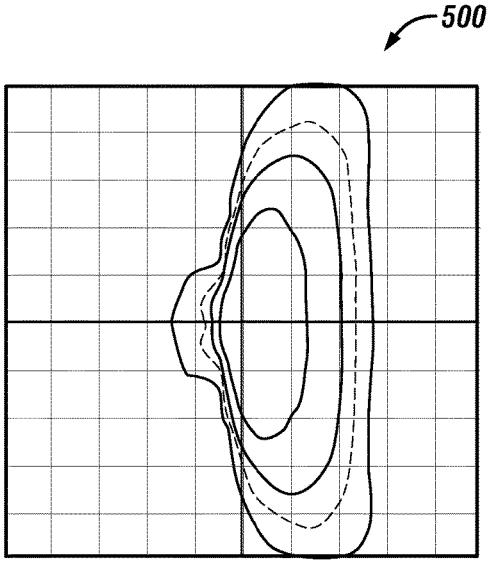
FIG. 5 illustrates a representative light distribution for the optic and the associated light emitting diode in the second configuration that FIG. 3 illustrates, according to some example embodiments of the present technology.

Turning now to FIGS. 4 and 5, these figures illustrate representative light distributions for the optic 100 and the associated light emitting diode 250 in the respective configurations of FIGS. 2 and 3 in accordance with some embodiments of the present technology.

FIG. 4 illustrates a representative light distribution 400 for the light source 200 in the first, Type II configuration that FIG. 2 illustrates. As discussed above, the light source 200 comprises the optic 100 and the associated light emitting diode 250 that may be independently movable. The illustrated distribution 400, which is a computer-generated simulation, provides a contour plot of horizontal illumination for the Type II distribution. Each line represents a different amount of light falling onto a surface. Near the center of the distribution 400, the light levels are greatest. As the contours of the distribution 400 progress outward, the light levels are reduced.

FIG. 5 illustrates a representative light distribution 500 for the light source 200 in the second, Type III configuration that FIG. 3 illustrates. The illustrated distribution 500, which is also a computer generated simulation, provides a contour plot of horizontal illumination for the Type III distribution. Each line represents a different amount of light falling onto the surface. Near the center of the distribution 500, the light levels are greatest. As the contours of the distribution 500 progress outward, the light levels are reduced.

Turning now to FIGS. 6, 7, and 8, another example embodiment of a light source 600 that supports adjustable light distributions is illustrated in three configurations. The light source 600 comprises an optic 601 and an associated light emitting diode 250. The optic 601 comprises a refractive optical element 626 comprising a refractive outer surface 625, a cavity 675 comprising a refractive inner surface 602, and a reflector 650 disposed in the cavity 675.

FIG. 6 illustrates the light source 600 in a first example configuration that produces a first light distribution pattern in accordance with some embodiments of the present technology. FIG. 7 illustrates the light source 600 in a second example configuration that produces a second, different light distribution pattern in accordance with some embodiments of the present technology. FIG. 8 illustrates the light source 600 in a third example configuration that produces a third, different light distribution pattern in accordance with some embodiments of the present technology.

In the embodiment of FIGS. 6, 7, and 8, the refractive optical element 626 has a smooth refractive outer surface 625, without the protruding totally internally reflective features 175 present in the embodiment of FIGS. 1-5. In the embodiment of FIGS. 6-8, a reflector 650 is disposed in the cavity 675 of the refractive optical element 626 along with the light emitting diode 250.

The light source 600 can be incorporated in a luminaire, for example for an outdoor roadway lighting application. In such an application, the reflector 650 can limit the amount of light emitted behind the luminaire (referred to as "house side") and redirect that light to the area in front of the luminaire (referred to as "street side").

The reflector 650 may be statically coupled to a substrate 605, with an accompanying heat sink for example. The reflector 650 may remain fixed with respect to the light emitting diode 250 as the refractive optical element 626 is adjusted laterally and/or transversally. Alternatively, the reflector 650 may be statically coupled with the refractive optical element 626. Additionally, the optic 601 (both the refractive optical element 626 and the reflector 650) may move together with respect to the light emitting diode 250 as adjusted laterally and/or transversally. FIGS. 6, 7, and 8 illustrate cross sectional views of the three configurations providing such flexibility.

FIGS. 6 and 7 show the reflector 650 fixed with respect to the light emitting diode 250, and the refractive optical element 626 is either adjusted forward (FIG. 6) or adjusted backward (FIG. 7). FIG. 6 illustrates a representative Type II configuration. FIG. 7 illustrates a representative Type III configuration.

FIG. 8 illustrates the reflector 650 fixed with respect to the refractive optical element 626 so that in an adjustment, the reflector 650 and the refractive optical element 626 move together as one with respect to the light emitting diode 250.

Technology for configurable light sources has been described. From the description, it will be appreciated that embodiments of the present technology overcome limitations of the prior art. Those skilled in the art will appreciate that the present technology is not limited to any specifically discussed application or implementation and that the embodiments described herein are illustrative and not restrictive. From the description of the exemplary embodiments, equivalents of the elements shown therein will suggest themselves to those skilled in the art, and ways of constructing other embodiments of the present technology will appear to practitioners of the art.

What is claimed is:

1. A light source comprising:

one or more light emitting diodes mounted on a substrate; and an optic oriented to process light produced by the one or more light emitting diodes, the optic comprising a refractive portion and a planar flange surrounding the refractive portion, the planar flange comprising a plurality of apertures for adjusting a position of the optic relative to the substrate, the refractive portion comprising:

an interior surface that forms a cavity facing the one or more light emitting diodes and that is operative to receive the light produced by the one or more light emitting diodes; and an exterior surface that is opposite the interior surface and that is operative to emit the light processed by the optic.

2. The light source of claim 1, wherein the apertures extend in a direction along a plane defined by the planar flange to provide greater relative positioning in the direction along the plane than in a second direction perpendicular to the plane.

3. The light source of claim 1, wherein the apertures allow freedom to move laterally and transversally.

4. The light source of claim 1, wherein the plurality of apertures comprise:

a first setting to configure the light source for a selected light distribution; and a second setting to configure the light source for another selected light distribution.

5. The light source of claim 1, wherein the optic comprises a reflector disposed entirely within the cavity formed by the interior surface of the optic, and wherein adjusting the position of the optic moves the reflector relative to the optic.

6. The light source of claim 1, wherein the optic comprises a reflector, and wherein adjusting the position of the optic moves the reflector relative to the one or more light emitting diodes.

7. The light source of claim 1, wherein the optic comprises a reflector, and wherein adjusting the position of the optic moves the reflector relative to the optic and to the one or more light emitting diodes.

8. The light source of claim 4, wherein the selected light distributions comprise two roadway classifications, and wherein the plane is vertical or horizontal.

9. A light source comprising:

an LED mounted on a substrate;

an optic disposed on the substrate, the optic comprising a refractive portion and a flange surrounding the refractive portion; and a mechanical system that links the LED and the optic to one another and that comprises a plurality of apertures in the flange, the plurality of apertures each receiving a fastener and providing a plurality of settings for configuring the light source to meet a corresponding plurality of light distributions.

10. The light source of claim 9, wherein the plurality of settings comprise a plurality of discrete settings.

11. The light source of claim 9, wherein each setting in the plurality of settings comprises a respective mechanical stop.

12. The light source of claim 9, wherein the mechanical system comprises a lead screw system, the lead screw system comprising:

a female threaded block fixed to the substrate; and a threaded screw that mates with the female threaded block and moves the optic.

13. The light source of claim 9, wherein the plurality of apertures allow movement in two directions.

14. The light source of claim 9, wherein the mechanical system is operative to provide linear motion between the LED and the optic.

15. The light source of claim 9, wherein the LED comprises a plurality of LEDs disposed in a cavity of the optic.

16. The light source of claim 9, wherein the flange comprises a flat surface adjoining the substrate, and wherein the mechanical system provides positioning between the plurality of settings define different positions for the flat surface relative to the substrate.

17. The light source of claim 9, wherein the plurality of light distributions comprise a plurality of roadway distribution classifications.

18. A light source that comprises:

one or more light emitting diodes mounted to a substrate; and an optic disposed to process light emitted by the one or more light emitting diodes, the optic comprising a refractive portion and a flange surrounding the refractive portion, the flange comprising an adjustment feature comprising a plurality of apertures for adjusting a position of the optic relative to the substrate, the adjustment feature further comprising a first setting and a second setting, wherein in the first setting the adjustment feature is operable to configure the light source to meet the first light distribution, and wherein in the second setting the adjustment feature is operable to configure the light source to meet the second light distribution.

19. The method of claim 18, wherein the first and second settings are discrete and provide different relative positions between the optic and the one or more light emitting diodes.

20. The method of claim 18, wherein the adjustment feature comprises predefined settings, the predefined settings comprising the first setting and the second setting.

* * * * *